United States Patent [19]

Poth

[11] 4,117,558

[45] Oct. 3, 1978

[54] COLLAPSIBLE TUB INSERT

[76] Inventor: Robert Poth, 1048 Val Martin, Laval, Canada, H7V 3K5

[21] Appl. No.: 843,868

[22] Filed: Oct. 20, 1977

[51] Int. Cl.[2] ..... A47K 3/00; A47K 3/06

[52] U.S. Cl. ..... 4/173 R; 4/177 R; 4/177 CW; 4/185 B

[58] Field of Search ..... 4/185 B, 6, 7, 177, 4/177 CW, 172, 173 R, 173 M, 174, 175, 182, 185 R, 185 HB, 185 S

[56] References Cited

U.S. PATENT DOCUMENTS

| | | | |
|---|---|---|---|
| 1,808,376 | 6/1931 | Polacek et al. | 4/177 R |
| 1,856,992 | 5/1932 | Goddess | 4/177 R |
| 2,096,395 | 10/1937 | Galt | 4/185 B |
| 2,614,264 | 10/1952 | Schmidt, Jr. | 4/185 B |
| 2,972,752 | 2/1961 | Rudolf | 4/177 R |
| 3,191,190 | 6/1965 | Lowry | 4/177 R |
| 3,559,216 | 2/1971 | Kyte | 4/177 R |
| 3,931,651 | 1/1976 | Weir | 4/177 R |
| 3,931,652 | 1/1976 | Navarra | 4/177 R |
| 4,017,915 | 4/1977 | Prewitt | 4/177 R |

*Primary Examiner*—Henry K. Artis
*Attorney, Agent, or Firm*—Robert D. Farkas

[57] ABSTRACT

A collapsible tub insert utilizes a unitary element having a base portion and walls upstanding therefrom. One portion of the walls includes a semi-rigid construction joined by an accordion pleated wall portion, similar to a "living-hinge" to the remaining semi-rigid wall portion. One of the wall portions includes an opening extending downwardly from the marginal edge thereof communicating to the interior of the enclosure defined by the wall and the base, the base material adjacent the accordion pleated area of the side wall portion is pleated permitting the pair of semi-rigid portions to be fully collapsed or to extend outwardly at selected locations, utilizing a spacing bar therefor. A drain hole communicates to the exterior of the collapsible insert.

7 Claims, 3 Drawing Figures

COLLAPSIBLE TUB INSERT

BACKGROUND OF THE INVENTION

1. The Field of the Invention

This invention relates to enclosures adapted for bathing purposes and more particularly to that class which is collapsible in nature.

2. Description of the Prior Art

The prior art abounds with enclosure suitable in the bathing process. U.S. Pat. No. 2,972,752 issued on Feb. 28, 1961 to L. E. Rudolf teaches a pair of U-shaped rigid frame elements adapted to be slideably engaged within one another forming an enclosed frame for use with a flexible sheet having four edges thereof adapted to removably engage the four sides of the frame. The assembled apparatus is intended to be inserted in a sink-like opening and thence filled with water in a bathing position. When not in use, the Rudolf apparatus may be totally disassembled. However, such a portable bathing device has a fixed size which stores substantial amounts of water when in use.

U.S. Pat. No. 2,096,395 issued on Oct. 19, 1937 to O. P. Galt describes a portable bathtub fabricated from a frame member and including an enclosure adapted to receive water therein, such enclosure being flexible in nature. This apparatus, similar to the Rudolf apparatus, also provides an enclosure whose capacity is not adjustable in nature.

U.S. Pat. No. 2,614,264 issued Oct. 21, 1952 to C. H. Schmidt, Jr. discloses a bathtub attachment for the care of babies employing a rigid miniature tub -like device adapted to rest upon the periphery of a tub enclosure and having a hingeable sheet affixed thereto serving as a securing means for the apparatus when not in use. The rigid bathtub, comprising the invention, is selectively positioned below the faucet portion of the supporting bathtub for easy filling. The miniature tub drains into the larger tube, utilizing a pluggable drain opening therefor. Such apparatus is bulky when not in use and also requires substantial amounts of water to entirely fill the apparatus to a convenient depth of water.

SUMMARY OF THE INVENTION

A primary object of the present invention is to provide a collapsible bathtub insert whose dimensions are conveniently adjusted when in a use position.

Another object of the present invention is to provide a bathtub insert that may be collapsed, occupying a minimum space when not in use.

Another object of the present invention is to provide a bathing device of varied dimensions, thereby permitting a wide variety of usages.

Still another object of the present invention is to provide a bathtub insert which may be installed on the floor of the tub, thereby minimizing the structural strength requirements of the apparatus.

Yet another object of the present invention is to provide a bathing device which utilizes a backrest portion comfortably molded to receive the back portion of a user.

A further object of the present invention is to provide a bathtub insert which may be easily filled when positioned below the faucet assembly of conventional bathtubs or sinks.

Another object of the present invention is to provide a bathing device which may be utilized on the floor, adjacent to the location of a faucet utilized to fill same with bathing water.

Still another object of the present invention is to provide a bathing device whose cost of manufacture and ease of maintenance provides an inexpensive and durable useful product.

Heretofore, collapsible bath devices utilize flexible film elements with or without collapsible supporting frames therefor. Such devices, when set up for use, required substantial amounts of water to fill same so as to obtain a height of water useful in certain bathing operations such as sitz baths or foot baths. Recent trends to conserve energy, including conservation of water, results in the need for a bathing device whose capacity to accept water therein is adjustable whilst permitting such water to be retained within the device during the entire bathing operation.

Heretofore, when it was desired to utilize a bathtub for bathing only small portions of the human body, it was necessary to fill a tub, partly or fully, thereby consuming substantial amounts of heated water. By utilizing a smaller tub, whose horizontal cross-section is controlled, small amounts of water are consumed thereby conserving fuel, water and minimizing the impact on drainage systems. It is only considered to be highly desirable to have such apparatus removably installed within a conventional tub apparatus for use therewithin, or after being filled under a conventional faucet, to be installed on to a horizontal supporting surface wherein varied parts of the body may by soaked, washed or bathed at the will of the user. Supporting portions of the user's back within the apparatus is also highly desirable and virtually impossible to achieve within conventional tubs by virtue of the fact that the user found it difficult to sit in the lower most regions of the tub because of the uncomfortable projection of the tub faucet over the lower most regions of the tub. The present invention, after being filled to any desired height and receiving any desired volume of water therewithin, can be displaced to any location within the tub, permitting the user's back to reside supported against a contoured resting surface comprising one portion of the wall element of the present invention. The apparatus comprising the present invention may be fabricated in a unitary fashion, thereby minimizing leaks and enhancing the cleaning process between bathing operations. By making the apparatus collapsible, the device occupies a minimum amount of space, when not in use.

DESCRIPTION OF THE PREFERRED EMBODIMENT

Figure 1:
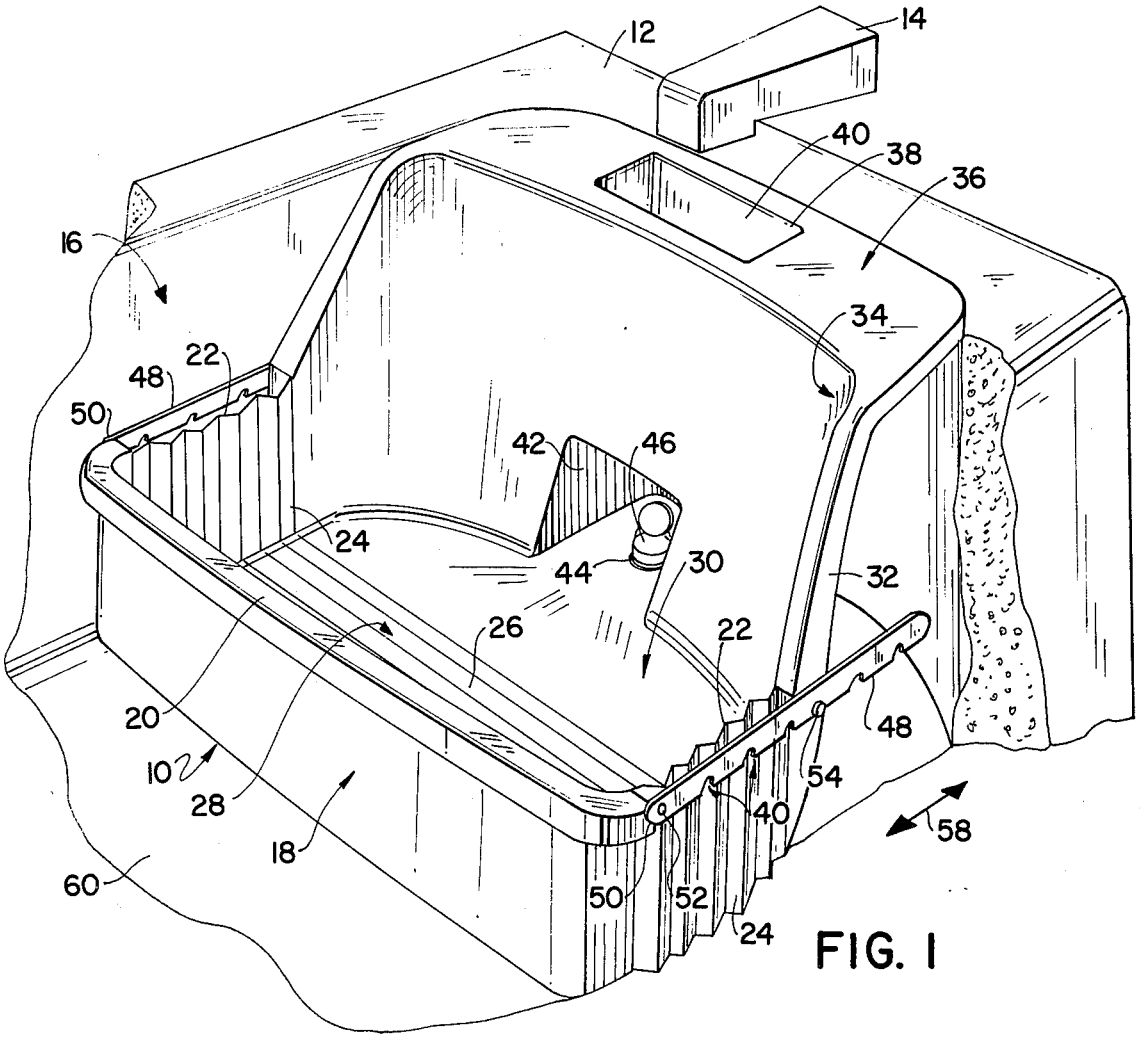
FIG. 1 is a perspective view of the present invention shown installed within a tub.

The structure and method of fabrication of the present invention is applicable to a container having side walls and a base portion; One of the side walls and an adjacent portion of the base thereto is fabricated from a semi-rigid material and is joined to adjacent base portions and side wall portions, fabricated from the same material, having alternate weakened score line areas and alternate semi-rigid areas of substantially thinner cross-section than the first mentioned wall and adjacent base portion. The remaining base portion and wall portion comprising the present invention are fabricated from the same material, being semi-rigid in nature but having the marginal edges thereof, describing the open mouth portion of the apparatus, extending substantially upwardly from the aforementioned semi-rigid and accordion-like pleated side and base portions. The remaining base portion is provided having a passageway communicating from the marginal edges thereof downwardly into the container formed by the side walls of the apparatus. The lower most regions of the passageway extend directly on to the base of the container and is provided with a drainage hole which communicates to the exterior surfaces of the containerA removable stopper may be installed into the drainage hole, thereby permitting the apparatus to the emptied or retaining fluid therewithin. A pair of metallic or plastic bars are provided,nding outwardly from the back-resting, taller, semi-rigid portion of the device. Thus, the short wall portion may be positioned at any desirable distance away from the tall wall portion, thereby creating a container of variable liquid capacity and useful size. When not in use, the bars are positioned so as to have a pair of notches therein engage the outwardly extending pins causing the short wall portion to reside immediately against the tall wall portion, maintaining the accordion-like pleated wall and base portions in a folded up condition. Thus, the apparatus occupies a minimum amount of space when not in use.

The entire apparatus, exclusive of the bars, may be fabricated in unitary fashion from a plastic material such as polypropylene. The bars are fabricated from a metallic material, preferably rust resistant in nature, such as stainless steel. The pivot rods, securing one end of the bars to the shorter wall, are fabricated from a similar rust-proof material, as are the outwardly extending pins. The rubber stopper may be of conventional design and fabricated from a rubber-like material such as polyvinylchloride.

The marginal edges defining the taller wall portion are substantially wider than the marginal edges of the remaining wall portions so as to provide an opening for the passageway of substantial size. The interior surface of the taller wall portion is contoured to accept the back of a user and provide support in a comfortable manner. The exterior surface of the taller wall portion comprises a rectangular shape, encircling the passageway. The bottom of the rectangular external surface i: provided having a notch therein communicating with the drainage hole in the floor of the container.

Now referring to the figures, and more particularly to the embodiment illustrated in FIG. 1 showing the present invention 10 shown residing within a conventional tub apparatus 12 having a faucet portion extending over the open mouth region 16 thereof. Short wall portion 18 is shown having a thickened upper most marginal edge 20 relative to the upper most marginal edges 22 of accordion-like pleated side wall portions 24. Pleated side wall portions 24 are shown permanently attached to short wall portion 18 and extend along side a pleated base portion 26. Such pleated side wall portions and short wall portions define an open mouth area 28 of the present invention suitable for bathing purposes. Base portion 30, shown adjacent tall wall portion 32 is semi-rigid in nature, possessing the same degree of rigidity as short wall portion 18. Wall portion 32 is provided having an interior surface 34 which is curved so as to provide a back support for a user. Marginal edge 36, adjacent tall wall portion 32, is shown having a thicker dimension than marginal edge 20 so as to provide an entrance port 38 of substantial size. Passageway 40, disposed within tall wall portion 32, extends downwardly therein so as to communicate with opening 42 in interior wall surface 34. Drainage hole 44 is shown located in base portion 30 and confined outwardly from internal wall surface 34 so as not to be in a location which interferes with placing portions of the human anatomy into the container. Plug or stopper 46 is dimensioned so as to reside removably within drainage hole 44, thereby preventing the flow of water, not shown, outwardly from the interior of the present invention. Bars 48 are shown installed on each side of the container having ends 50 thereof pivotably secured to short wall 18, utilizing rivet 52 therefor. Pin 54 extends outwardly from the exterior surface of tall wall 32 and is shown residing in one of a plurality of notches 56 extending upwardly from the lower most edge of bar 48. Thus, positioning pin 54 in another notch 56 permits short wall 18 to be selectively positioned in the direction of arrows 58 at the will of a user. If desired, present invention 10 may be utilized as shown, within tub 12 or, installed on any convenient supporting surface. As shown, present invention 10 is residing on floor 60 of tub 12.

Figure 2:
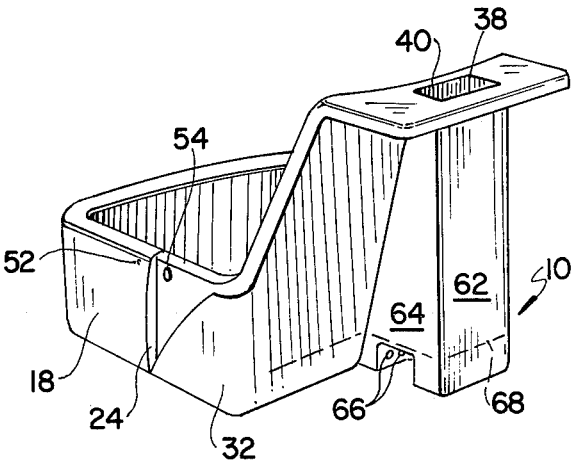
FIG. 2 is another perspective view of the present invention.

FIG. 2 illustrates short wall 18 shown disposed residing directly against tall wall 32 so as to have pleated wall portion 24 in a collapsed condition. Bar 48, shown in FIG. 1, is illustrated removed so as to clearly indicate the position of rivet 52 and outwardly extending pin 54. Port 38 is shown directly over exterior surfaces 62 and 64, each defining a vertical column surrounding passageway 40, as shown in FIG. 1. Drain holes 66 are shown, which communicate fluidly with drainage hole 44, shown in FIG. 1. Passageway 40 is defined by external surfaces 62 and 64 terminating alongst dotted lines 68, representing the internal floor, of the present invention.

Figure 3:
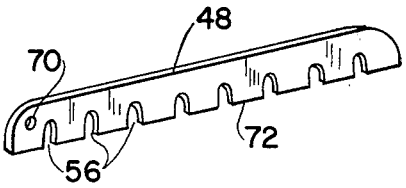
FIG. 3 is a perspective view of a portion of the present invention.

FIG. 3 illustrates bar 48, having hole 70 therein, for engagement with rivet 52, shown in FIG. 1. Notches 56 are shown extending alongst the length of lower most edge 72, of bar 48, in spaced apart relationship.

One of the advantages of the present invention is a collapsible bathtub insert whose dimensions are conveniently adjusted when in a used position.

Another advantage of the present invention is a bathtub insert that may be collapsed, occupying a minimum space when not in use.

Another advantage of the present invention is a bathing device of varied dimensions, thereby permitting a wide variety of usages.

Still another advantage of the present invention is a bathtub insert which may be installed on the floor of the tub, thereby minimizing the structural strength requirements of the apparatus.

Yet another advantage of the present invention is a bathtub insert which may be easily filled when positioned below the faucet assembly of conventional bathtubs or sinks.

Another advantage of the present invention is a bathing device which may be utilized on the floor, adjacent to the location of a faucet utilized to fill same with bathing water.

Still another advantage of the present invention is a bathing device whose cost of manufacture and ease of maintenance provides an inexpensive and durable useful product.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

The embodiment of the invention in which an exclusive priviledge of property is claimed are defined as follows:

1. A collapsible tub insert comprising a container having a base and walls extending upwardly therefrom, said base and said walls defining an open mouth portion residing above said base and adjacent the upper most marginal edges of said walls, a pair of portions of said walls having a pleated-like cross-section, said pleated-like cross-section defined by a plurality of vertical lines extending upwardly from said base to said marginal edges, a portion of said base having a pleated-like construction, said pleated-like construction of said base defining a plurality of horizontal lines, said plurality of horizontal lines intersecting said plurality of vertical lines, another portion of said walls having the upper most marginal edge thereof residing substantially in the same plane as the marginal edges of said pair of portions of said walls, the remaining portion of said walls having the marginal edge thereof extending upwardly from said marginal edge of said pair of portions, a passageway located in said remaining portion of said wall, one end of said passageway located in said marginal edge of said remaining portion of said walls, the other end of said passageway fluidly communicating to said base and extending passing through an opening in the interior surface of said remaining portion of said wall, said opening being located adjacent said base, said passageway having a drainage hole communicating to an exterior surface of said remaining portion of said walls, a stopper, said stopper removably installed closing said drainage hole, means to manually position said portion of said walls at selected locations away from said remaining portion of said walls.

2. The apparatus as claimed in claim 1 wherein said means to position comprises at least one bar, one end of said at least one bar pivotably secured to said another portion of said walls, said bar having a plurality of notches disposed in spaced apart relationship along the length thereof, a pin, said pin extending outwardly from the surface of said remaining portion of said walls, said plurality of notches each being configured for removable engagement retaining a portion of said pin therein, whereby said another portion of said wall may be positioned at a selected distance away from said remaining portion of said wall by selective use of one of said plurality of notches.

3. The apparatus as claimed in claim 1 wherein said base and said walls comprise a unitary structure.

4. The apparatus as claimed in claim 3 wherein the material comprising said base and said walls is a plastic.

5. The apparatus as claimed in claim 4 wherein said plastic is polypropylene.

6. The apparatus as claimed in claim 1 wherein the interior surface of said remaining portion of said wall is curved.

7. The apparatus as claimed in claim 2 wherein one of said plurality of notches is positioned along the length of said at least one bar whereby said pair of portions of said walls may be disposed in a collapsed condition maintaining said another portion of said walls adjacent said remaining portion of said walls.

* * * * *